United States Patent [19]

Mielsch et al.

[11] 4,340,620

[45] Jul. 20, 1982

[54] METHOD FOR ACTIVATING TITANIUM SURFACES FOR SUBSEQUENT PLATING WITH METALLIC COATINGS

[75] Inventors: Götz Mielsch; Rolf Dunker; Martin Thoma, all of Munich, Fed. Rep. of Germany

[73] Assignee: MTU Motoren-und Turbinen-Union, Munich, Fed. Rep. of Germany

[21] Appl. No.: 238,627

[22] Filed: Feb. 26, 1981

[30] Foreign Application Priority Data

Mar. 4, 1980 [DE] Fed. Rep. of Germany ..... 3008314

[51] Int. Cl.[3] ..... C23B 5/62

[52] U.S. Cl. ..... 427/292; 427/304; 427/309; 204/32 R

[58] Field of Search ..... 427/309, 444, 292, 304, 427/305; 204/32 R

[56] References Cited

U.S. PATENT DOCUMENTS

| | | | |
|---|---|---|---|
| 2,471,909 | 5/1949 | Spruance | 148/6.2 |
| 2,825,682 | 3/1958 | Missel et al. | 204/32 R |
| 2,829,091 | 4/1958 | Missel | 204/32 |
| 3,817,844 | 6/1974 | Kendall | 204/32 R |
| 3,891,456 | 6/1975 | Hohman et al. | 134/3 |

FOREIGN PATENT DOCUMENTS 1307649 2/1973 United Kingdom .

*Primary Examiner*—Ralph S. Kendall

*Attorney, Agent, or Firm*—Posnack, Roberts, Cohen & Spiecens

[57] ABSTRACT

A method for activating titanium surfaces for subsequent plating with metallic coatings comprising:

(a) wet peening the titanium surface to be plated using fine-grain $Al_2O_3$, (b) pickling the peened surface with a fluoridic solution at room temperature for several minutes, and (c) activating the surface with a solution containing chromium, fluorine, and arsenic or antimony at temperatures of 35° to 100° C. for fifteen to fifty minutes.

The molar ratio of fluorine to arsenic or antimony is between six and seven, and the molar ratio of chromium to antimony or arsenic is between three and six.

4 Claims, No Drawings

METHOD FOR ACTIVATING TITANIUM SURFACES FOR SUBSEQUENT PLATING WITH METALLIC COATINGS

FIELD OF THE INVENTION

This invention relates to methods for activating titanium surfaces for subsequent plating with metallic coatings.

PRIOR ART

Heretofore, titanium because of its pronounced passivation tendency, has admitted of plating only after very extensive pretreatment and with normally inadequate results even after such treatment.

SUMMARY OF THE INVENTION

An object of the invention is to provide a method for pretreating titanium surfaces such that they are permanently activated for electroplating as well as electroless plating, in which the method is simple for production applications in terms of both the overall requisite duration of the process and the implementation of the various steps of the process.

In accordance with the invention, the method for pretreating the titanium surface comprises activating the surface with a solution consisting essentially of arsenic or antimony; chromium; and fluorine.

The constituents of the solution are present in amounts so that (a) the molar ratio of fluorine to arsenic or antimony is between 6 and 7

(b) the molar ratio of chromium to arsenic or antimony is between 3 and 6.

The concentration of the antimony or arsenic component of the solution is between 0.1 and 2.1 Mol/l.

The arsenic or antimony component can be in the form of an oxide, acid, fluoride or fluorine complex compound.

Prior to activation of the surface with the aforesaid solution, said surface is subjected to a wet peening operation using fine-grain $Al_2O_3$. Thereafter, the peened surface is pickled using a fluoridic solution at room temperature for several minutes. The fluoridic solution can be constituted by a mixture of nitric acid and hydrofluoric acid. According to a specific embodiment, the nitric acid is present in an amount of 400 g/l and the hydrofluoric acid in an amount of 5 g/l.

DESCRIPTION OF PREFERRED EMBODIMENTS

In accordance with the invention, there is provided a method for activating titanium surfaces for subsequent plating with metallic coatings. The method comprises a succession of steps including first wet peening the titanium surface to be plated using fine-grain $Al_2O_3$, then pickling the surface with a fluoridic solution at room temperature for several minutes, and thereafter activating the surface with an activating solution. The treatment with the activating solution is effected at a temperature between 35° and 100° C. for 15 to 50 minutes.

An especially lasting type of passivation is achieved when the solution used for activating the surface consists of antimony or arsenic, a fluoride and chromium in amounts such that:

(a) the molar ratio of fluorine to arsenic or antimony is between 6 and 7

(b) the molar ratio of chromium to arsenic or antimony is between 3 and 6.

Within these limits, excellent passivation can be achieved according to a preferred embodiment of the present invention when titanium is treated with a solution having the following molar concentrations:

| | |
|---|---|
| Sb or As | 0.5 Mol/l |
| HF | 3.3 Mol/l |
| $CrO_3$ | 1.6 Mol/l |

Although the respective concentration of antimony or arsenic in the activation solution has no major significance for the results obtained in activation, it will be beneficial to select an antimony or arsenic concentration of 0.1 to 2.0 Mol/l. The antimony or arsenic can be supplied in the solution as oxides, acids, fluorides, or fluorine complex compounds.

A preferred specific make-up of activating solution contains

| | |
|---|---|
| 160 g/l | $CrO_3$ |
| 150 ml | 40% solution of HF |
| 70 g/l | $Sb_2O_3$ |

The antimony or arsenic compounds can be, for example, $As_2O_3$, $As_2O_5$, $AsF_3$, $H_3AsO_4$, $Sb_2O_3$, $Sb_2O_5$, $SbF_3$, $SbF_5$ or $Me^I$ $(SbF_6)$ wherein $Me^I$ is an alkali metal.

The fluoridic pickling solution is preferably a mixture of nitric acid and hydrofluoric acid in a concentration of 400 g/l of nitric acid for 5 g/l of hydrofluoric acid.

It has been found that with the method of the invention, metal layers can be deposited on titanium surfaces by conventional methods with an especially good bond having adhesive strengths reaching 70 $N/mm^2$ and above. A particular advantage afforded by the method of the present invention is that after the various steps of the method have been carried out, the titanium surface will remain activated for several days. A further advantage provided by the method of the present invention is that heat treatment for improving the bond after plating is no longer necessary. All steps of the process can be performed at temperatures below 60° C., which permits the use of wax masking as needed for selective plating. This considerably simplifies selective plating. A further advantage is that hydrogen absorption by the base material is precluded.

Although the invention has been described in conjunction with preferred embodiments thereof, it will become apparent to those skilled in the art that numerous modifications and variations can be made within the scope and spirit of the invention as defined by the attached claims.

What is claimed is:

1. A method for activating titanium surfaces for subsequent plating with metallic coatings, said method comprising:

(a) wet peening the titanium surface to be plated using fine-grain $Al_2O_3$, (b) pickling said surface with a fluoridic solution at room temperature for several minutes, said fluoridic solution being a solution of nitric acid and hydrofluoric acid, (c) activating said surface with a solution consisting essentially of chromium acid or hexavalent chromium compounds, hydrofluoric acid, and arsenic or antimony at temperatures of 35° to 100° C. for 15 to 50 minutes, the molar ratio of fluorine to arsenic or antimony being between 6 and 7 and the molar ratio of chromium to arsenic or antimony being between 3 and 6, the concentration of antimony or arsenic in said solution being between 0.1 and 2.0 Mol/l.

2. A method as claimed in claim 1 wherein for the activating solution, the arsenic or antimony is an oxide, acid, fluoride or fluorine complex compound.

3. A method as claimed in claim 2 wherein the arsenic or antimony compound is $As_2O_3$, $As_2O_5$, $AsF_3$, $H_3AsO_4$, $Sb_2O_5$, $SbF_3$, $SbF_5$, or $Me^I(SbF_6)$ wherein $Me^I$ is an alkali metal.

4. A method as claimed in claim 1 wherein the concentration of the fluoridic pickling solution is:

400 g/l $HNO_3$ and 5 g/l HF.

* * * * *